US005888440A

United States Patent [19]

Steinmetz

[11] Patent Number: 5,888,440

[45] Date of Patent: Mar. 30, 1999

[54] METHOD FOR MANUFACTURING MIXING IMPELLER

[75] Inventor: Michael Steinmetz, Moscow, Pa.

[73] Assignee: Norstone, Inc., Melrose Park, Pa.

[21] Appl. No.: 23,592

[22] Filed: Feb. 26, 1993

Related U.S. Application Data

[62] Division of Ser. No. 642,522, Jan. 17, 1991, Pat. No. 5,201,635.

[51] Int. Cl.[6] ..... B28C 39/08

[52] U.S. Cl. ..... 264/255; 264/311

[58] Field of Search ..... 264/255, 256, 264/310, 311, 301, 302, DIG. 60

[56] References Cited

U.S. PATENT DOCUMENTS

| | | | |
|---|---|---|---|
| 3,052,927 | 9/1962 | Hoppe et al. | 264/255 X |
| 3,652,368 | 3/1972 | Formo | 264/311 X |
| 3,751,181 | 8/1973 | Hayashi . | |
| 3,949,425 | 4/1976 | Roberts | 264/255 X |
| 3,997,645 | 12/1976 | Dempster | 264/311 X |
| 4,022,855 | 5/1977 | Hamblen | 264/311 X |
| 4,154,789 | 5/1979 | Delacoste | 264/255 X |
| 4,171,166 | 10/1979 | Trowbridge et al. | 416/236 X |
| 4,294,880 | 10/1981 | Nishida | 264/255 X |
| 4,472,340 | 9/1984 | Boden et al. | 264/311 X |
| 4,548,779 | 10/1985 | Steinberg et al. | 264/311 X |
| 4,768,574 | 9/1988 | Probst | 264/255 X |
| 4,836,963 | 6/1989 | Gilman, Jr. | 425/435 X |
| 4,851,190 | 7/1989 | Bowen et al. | 264/71 X |
| 4,855,096 | 8/1989 | Panaroni | 264/311 X |
| 5,073,321 | 12/1991 | Wheeler | 264/255 X |
| 5,096,627 | 3/1992 | Vogelgesang et al. | 264/311 X |

*Primary Examiner*—Karen Aftergut

[57] ABSTRACT

A method of making an impeller having inner and outer portions of polyurethane resin having different flexibilities with the outer portion bonded to the inner portion and having greater flexibility than the inner portion, includes rotating a centrifugal casting mold containing a polyurethane resin forming material of predetermined composition, introducing into the inner portion of the mold another polyurethane resin forming composition of different composition than the first material, centrifugal casting the inner and outer portions together, and curing the resulting shape to form a disk having bonded inner and outer portions of polyurethane resin having different flexibilities.

3 Claims, 5 Drawing Sheets

METHOD FOR MANUFACTURING MIXING IMPELLER

This is a division of application Ser. No. 07/642,522 filed Jan. 17, 1991, now U.S. Pat. No. 5,201,635.

FIELD OF THE INVENTION

This invention relates to a composite, multiple-layered polyurethane mixing impeller for mixing materials in, for example, liquid-liquid or liquid-solid systems. The invention is also directed to a method of making an impeller which is well-suited, but not limited, to mixing pigments or other abrasive particles with liquids to form paints, cements and the like. However, the invention is applicable to impellers for all types of mixing.

BACKGROUND OF THE INVENTION

There are a number of situations where two or more liquids or particles and liquids must be mixed to a high degree of homogeneity, such as mixing of pigments in paint. There are also situations in which a suspended solid must be mixed to a high degree of homogeneity within a liquid, such as a mixture of sand slurry within paint for use on cinder blocks. A common operation to effect this homogeneity is to immerse into the liquid an impeller fixed to a rotatable shaft, as disclosed in Trowbridge et al U.S. Pat. No. 4,171,166, granted Oct. 16, 1979. The impeller should be of such a shape as to create turbulent flow of the liquid when the impeller is rotated by the shaft. Turbulent flow of a liquid within a container includes two types of fluid motion: large-scale (bulk circulation) and small-scale (turbulent eddies). Bulk circulation results when the fluid stream is discharged by the impeller. Turbulent eddies are generated mostly by the velocity discontinuities adjacent to the stream of fluid flowing from the impeller, and are carried to all parts of the container. This turbulent flow effects mixing of the liquids, or of the solid with the liquid.

A typical prior art impeller is shown in FIGS. 8 and 9. The impeller 80 generally comprises a flat metal disk 82 having a plurality of vanes or blades 84 extending from their edges. Often, these vanes are bent slightly upward or downward relative to the plane of the disk, so that fluid flowing along the surface of the disk will be guided below or above the disk, causing a vertical flow within the container.

A common disadvantage of this type of impeller is severe abrasion. The speed with which the impeller wears down, especially if used to mix liquids having abrasive suspended solids therein, is excessive. Over a short time, the impeller will erode and lose its original shape to the extent that it will cease to create the desired currents in the liquid. An expense is incurred every time the impeller needs to be replaced. Replacement of each impeller causes a certain amount of down-time for the task at hand. Further, particles of metal may be broken off the impeller and become suspended within the liquid that is being mixed, contaminating the mixture.

It is an object of the present invention to provide an improved impeller for mixing liquids, which lasts considerably longer than impellers of the prior art.

SUMMARY OF THE INVENTION

The present invention is directed to a conjugated or interlayered polyurethylene impeller created to be disposed on a rotating shaft and immersed in a liquid to be mixed. It includes inner and outer portions of polyurethane resin having different flexibilities, the outer portion being bonded to the inner portion and having greater flexibility than the inner portion. The impeller preferably has the general prior art shape of a disk with grooves. Each groove preferably but not necessarily has a curved profile when viewed from the edge of the disk, and the grooves of one face of the disk are offset with respect to the grooves on the other face, so that a groove on one face is spaced between the two adjacent grooves on the other face.

The invention is also directed to a novel method for centrifugally casting an impeller made of different portions of polyurethane having different flexibilities.

BRIEF DESCRIPTION OF THE DRAWINGS

For the purpose of illustrating the invention, the drawings show forms which are presently preferred; it being understood, however, that this invention is not limited to the precise arrangements and instrumentalities shown.

DETAILED DESCRIPTION OF THE DRAWINGS

Figure 1:
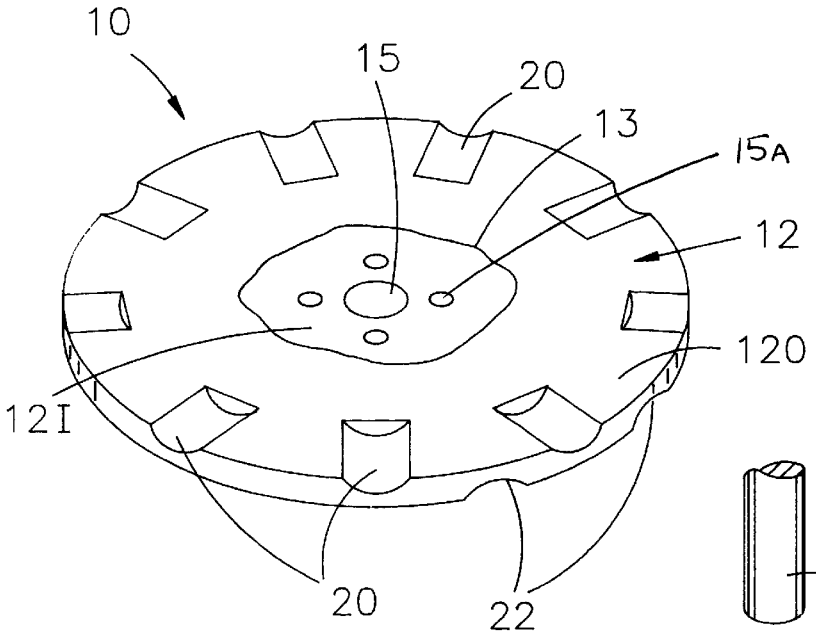
FIG. 1 is a perspective view of one form of the impeller of the present invention.

FIG. 1 is a perspective view of an impeller 10 of the present invention. Impeller 10 comprises a disk 12 with at least a central bore 15, adapted to accept the end of a shaft. A plurality of grooves 20 and 22 extend from the edge of disk 12 to approximately one-fourth the distance to the center of the face of disk 12 and grooves 22 are formed in the opposite face of disk 12.

It is important in accordance with this invention that the disk 12 has a composite structure composed of at least two different types of polyurethane resins 12 I and 12 O securely bonded to each other at the interfacial bond 13. Thus the inner disk portion 12 I and the outer disk portion 12 O comprise inner and outer portions of polyurethane resin having different flexibilities, the outer portion being bonded to the inner portion and having greater flexibility than the inner portion, and are preferably chemically reacted with each other to form a chemical bond.

Preferably the inner less flexible and harder disk portion 12 I has a Durometer hardness above about 95 Shore A (more preferably about 75 Shore D) and an elongation at break of about 270%, while the more flexible and softer outer disk portion 12 O has a Durometer hardness below about 95 Shore A (more preferably at about 95 Shore A) and a minimum elongation at break of about 400%, or in the range of about 400–800%.

Turning now to particular disk structures, as can be seen in FIG. 1, each of the grooves 20 and 22 is formed in the outer, more flexible disk portion 12 O and has a curved profile when viewed from the edge of disk 12. The center lines of each of the grooves 20 and 22 are radii from the harder, less flexible center of the disk 12, and the sides of each of the grooves 20 and 22 are parallel to the center line. The space thus defined by each groove is a portion of a right cylinder. The edges of the grooves do not taper to the center of the disk. Preferably there are approximately zero to nine such grooves and no more than ten, on each face of disk 12. The grooves 20 on the top face of disk 12 and the grooves 22 on the bottom face of disk 12 are circumferentially offset so that the grooves on one face are spaced between the grooves on the other face.

This impeller 10 is designed to be secured to a rotatable shaft and immersed in a liquid to be mixed, and the groove design may be the same as or different than a prior art disk made of a single type of polyurethane resin. It has surprisingly been discovered that the composite disk according to this invention has radically improved resistance to abrasion in a wide variety of mixing situations, and that this is attributable to the fact that the disk is composed of inner and outer portions of polyurethane resin having different flexibilities, the outer portion being bonded to the inner portion and having greater flexibility than the inner portion, and the outer portion 12 O being softer and more flexible than the inner portion 12 I. Upon repeated collisions with abrasive particles the softer polyurethane resin appears to yield with each impact instead of directly opposing it, and its characteristics of softness and flexibility contribute to unprecedented long wear. The harder, less flexible inner portion 12 I coacts by providing a relatively rigid, unyielding support and its hardness is beneficial in providing structurally strong connections of various designs to the impeller shaft.

In the art of mixing, there are several existing machines which may be used to rotate the impeller. Three preferred prior art structures for mounting the impeller of the present invention on various types of machines are described below.

Figure 2:
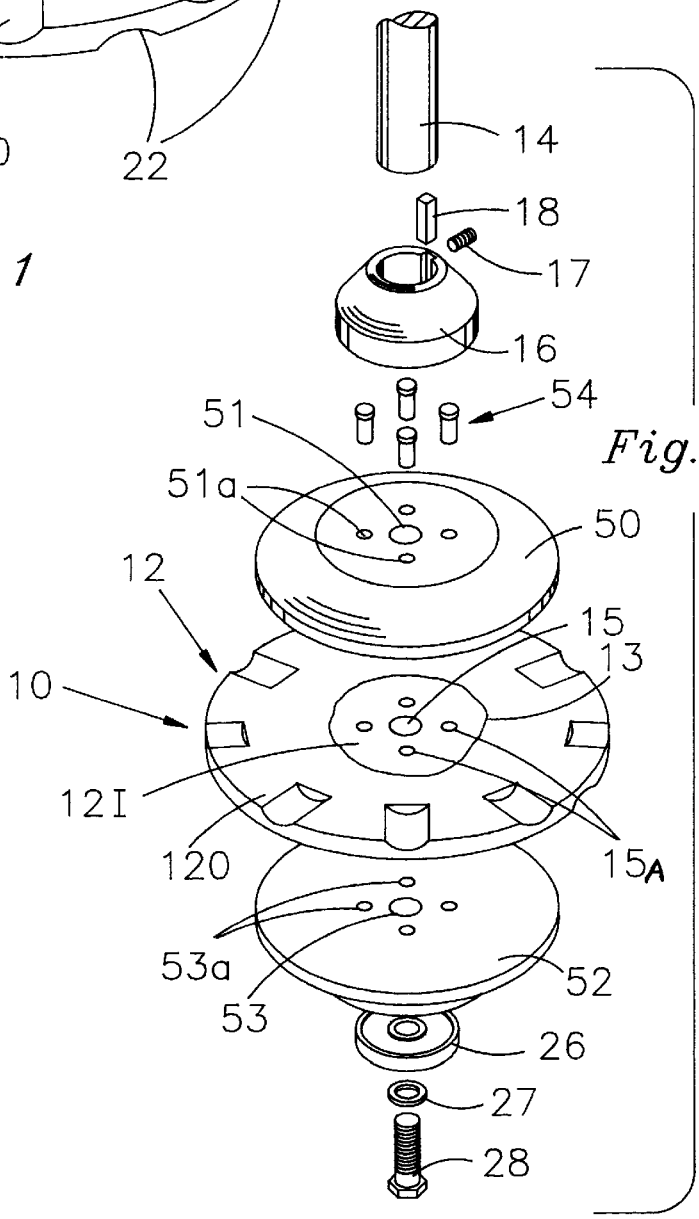
FIG. 2 is an exploded view showing one prior art mounting structure for the novel impeller of the present invention.

FIG. 2 shows one type of mounting means for attaching impeller 10 on a rotatable shaft 14. In addition to central bore 15, the impeller 10 of this embodiment further includes a plurality of openings 15*a* arranged around the central bore 15. Engaging the surfaces on either side of impeller 10 are mounting plates 50 and 52.

Upper mounting plate 50 has a central bore 51 with surrounding small bores 51*a*, which align with the central bore 15 and surrounding bores 15*a*, respectively, in disk 12. Similarly, lower mounting plate 52 includes central bore 53 with surrounding bores 53*a*, which align with openings 15 and 15*a*. The central bores 51, 15 and 53 accept a central bolt 28 therethrough. A set of torque transfer pins 54 is disposed through the aligned surrounding openings 51*a*, 15*a*, and 53*a*. The bolt 28 extends through a lock washer 27, a retaining washer 26, the plates 50 and 52, the disk 12 and collar 16, and threads into the lower end of the shaft 14 to hold the impeller and collar on the shaft. Collar 16 is secured around shaft 14 by means of a set screw 17, which urges a key 18 against the side of shaft 14. Shaft 14 may be provided with a shallow cavity in its side to accept the key 18.

Figure 3:
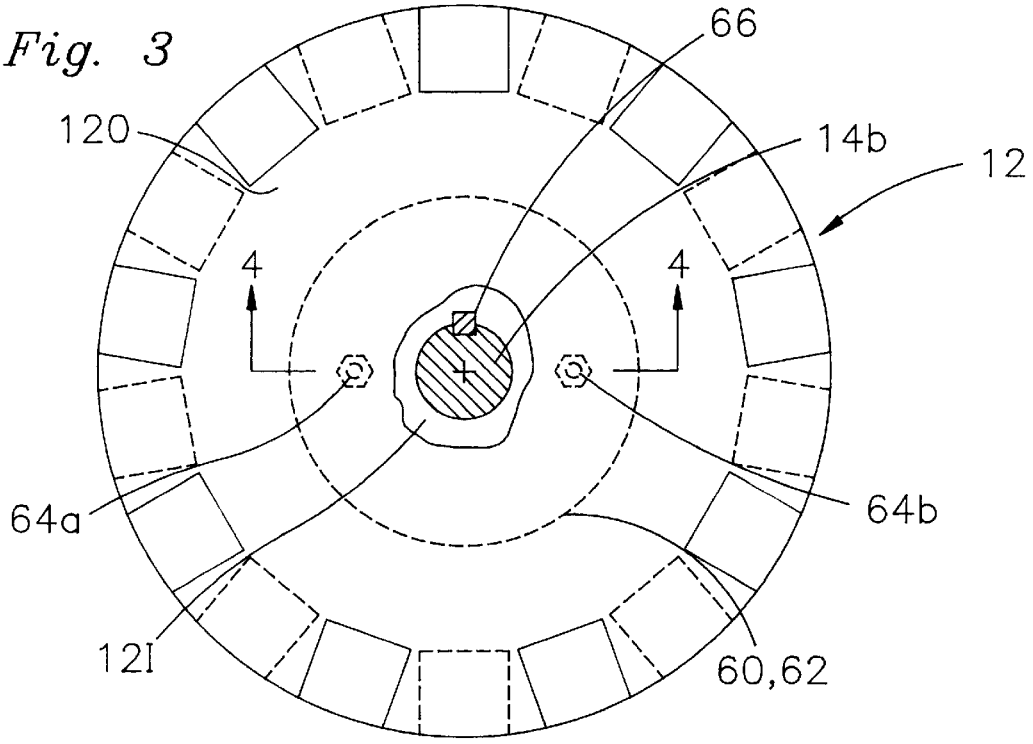
FIG. 3 is a top plan view of a second prior art mounting structure for the novel impeller of the present invention.
Figure 4:
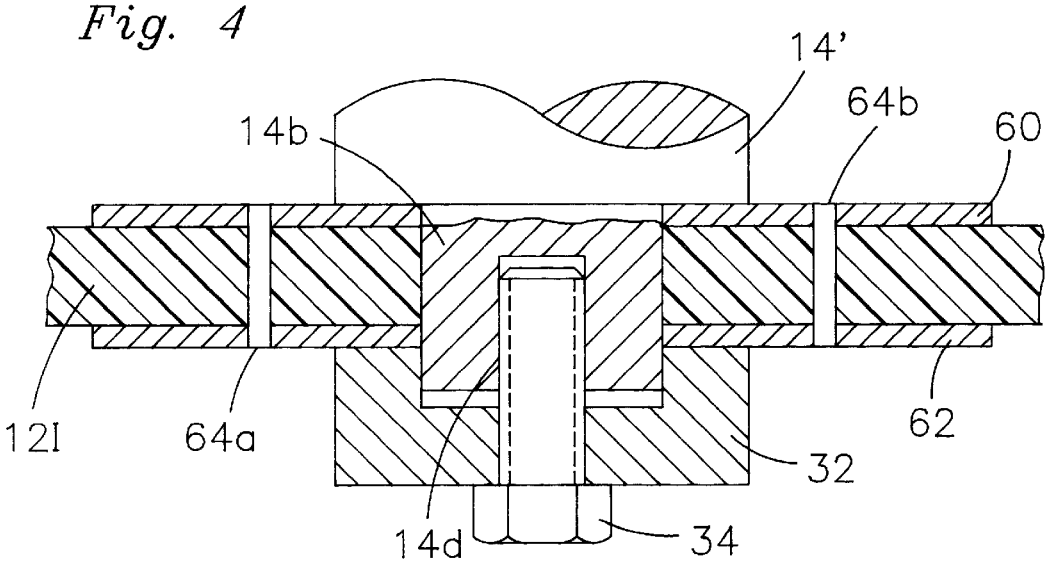
FIG. 4 is a sectional view of the center hub of the second mounting structure for the novel impeller of the invention, as viewed through line 4—4 of FIG. 3.

FIGS. 3 and 4 show another prior art mounting structure, in which rotatable shaft 14' terminates in a substantially cylindrical reduced diameter portion 14*b*. (FIG. 4) The reduced diameter portion 14*b* fits into the bore 15, and is of sufficient length so that a portion of the reduced diameter portion 14*b* protrudes through the opposite side of bore 15. Cap 32 (FIG. 4) fits over the protruding portion of reduced diameter portion 14*b*. Cap 32 defines an opening to accept bolt 34. Bolt 34 is anchored in threaded cavity 14*d* in reduced diameter portion 14*b*, thus securing cap 32 against impeller 10 and thereby securing impeller 10 on shaft 14'.

Adjoining reduced diameter portion 14*b* where it passes through opening 15 and impeller 10 is a key 66. Key 66 is preferably of a square shape and fits into a cavity in the side of reduced diameter portion 14*b* and a keyway cut into the edge of opening 15. Key 66 thus aids in transferring rotary motion from the shaft 14*b* to the impeller 10. However, high rotational speeds and/or high density of the liquid being mixed will result in extremely high stresses being placed on key 66, to the extent that forces between the shaft 14' and disk 10 may cause key 66 to break. In order to provide more support for the torque of the impeller 10, this prior art mounting structure preferably includes two mounting plates 60 and 62 on either side of the impeller 10. Parallel to the central opening 15 are smaller openings in which are disposed torque transfer pins 64*a* and 64*b*. The torque transfer pins are preferably in the form of roll pins or solid pins so as to engage openings in mounting plates 60 and 62, as shown, thus securing the mounting plates to the impeller 10. It is preferable to have the torque transfer pins 54*a* and 64*b* disposed at a distance from the center of the impeller greater than the diameter of shaft 14' and cap 32, so that the nut ends or bolt ends of the torque transfer pins 64*a* and 64*b* do not interfere with the secure contact between the surface of the mounting plates 60 and 62 and the end of shaft 14' and tap 32. Spacing the torque transfer pins 64*a* and 64*b* a sufficient distance from the center of the impeller 10 also has the advantage of allowing either face of the impeller 10 to face upward relative to the shaft 14, the advantages of which will be explained below.

Figure 5:
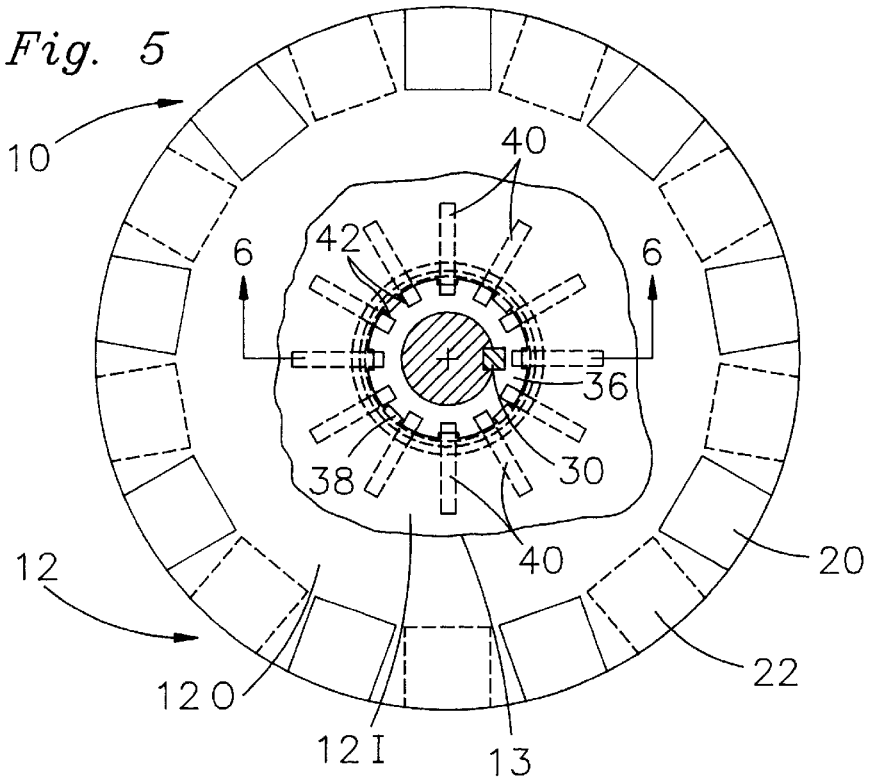
FIG. 5 is a top plan view of a third prior art mounting structure for the novel impeller.
Figure 6:
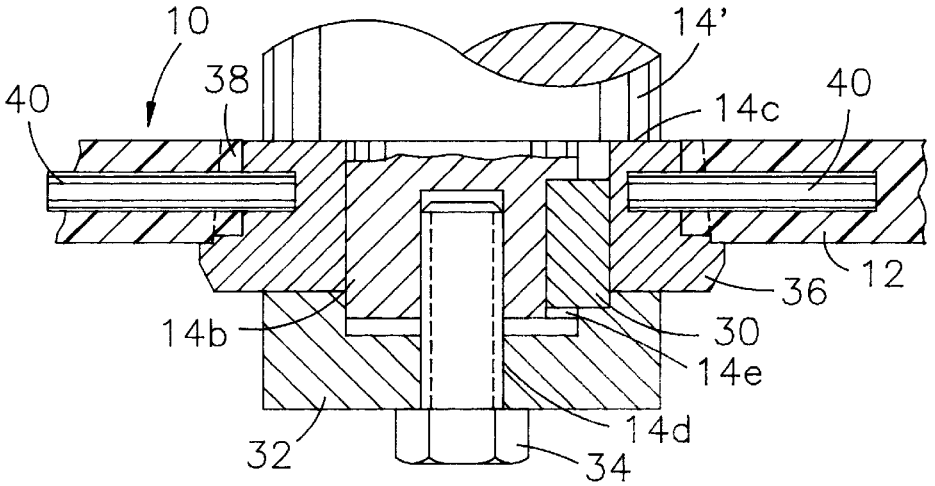
FIG. 6 is a sectional view through the center hub of the third mounting structure for the novel impeller of the invention, as viewed through line 6—6 of FIG. 5.

Many common types of mixing equipment, such as "Hockmeyer" machinery, have shafts which require attachments to a metal bushing. FIGS. 5 and 6 show an embodiment of prior art mounting structure having a metal bushing 36 disposed around opening 15. In this mounting structure, the attachment to shaft '14 is made as in the previous mounting structure, with bolt 34 fitting into an opening 14*d* and urging a cap 32 against the impeller 10. Block 30 fits into a longitudinal slot 14*e* in reduced diameter portion 14*b*.

Block 30 serves to urge the sides of reduced portion 14*b* firmly against the interior surface of the opening 15 formed by the bushing 36. This urging prevents wobbling or lateral movement of the impeller 10 when rotated at high speed. Bushing 36 may also include a plurality of grooves 38 keyed to corresponding ribs in disk 12 which prevent motion of the disk 12 relative to the hub 36 when impeller 10 is rotated at a high speed.

When using a metal bushing at the center of the impeller 10, it is preferable to include a plurality of radially extending stiffening ribs 40. The stiffening ribs 40 serve to maintain the rigidity of the disk 12, and to prevent motion of the disk 12 relative to bushing 36, as well as helping to positively retain disk 12 on bushing 36.

The outer circumferential surface of bushing 36 may be provided with a plurality of small openings 42 into which a number of individual ribs 40 are inserted. Alternatively the ribs may be integral with bushing 36. The bushing 36 with ribs 40 is introduced into the plastic mold as the disk portion 12 of the impeller 10 is being manufactured, so that the outer ends of the ribs 40 are embedded in the molded material in the finished product. Preferably, impeller 10 having a metal bushing 36 will include 10–12 ribs, when impeller 10 has a diameter greater than 12 inches. Of course, the number and arrangement of ribs, and the size of the impeller 10, may be varied as desired without departing from the scope of the invention.

Figure 7:
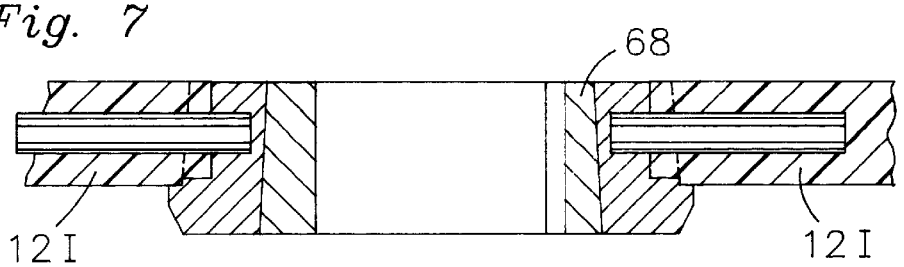
FIG. 7 shows a variation of the third mounting structure for the novel impeller.
Figure 8:
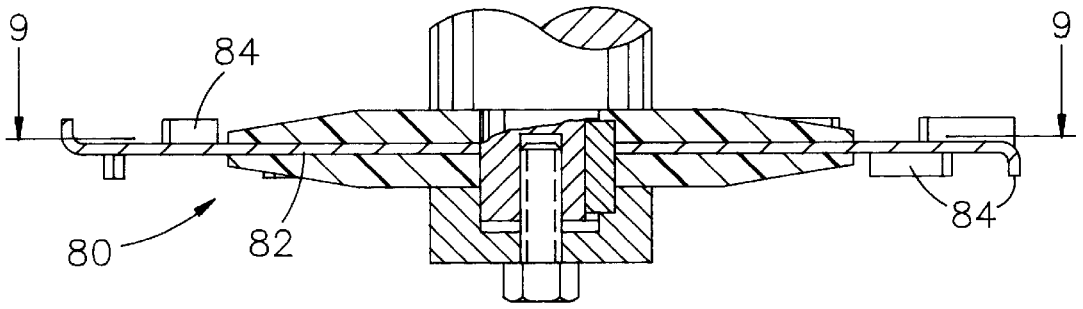
Fig. 8 PRIOR ART
FIGS. 8 and 9 are side and plan views, respectively, of a metal impeller of the prior art.
Figure 9:
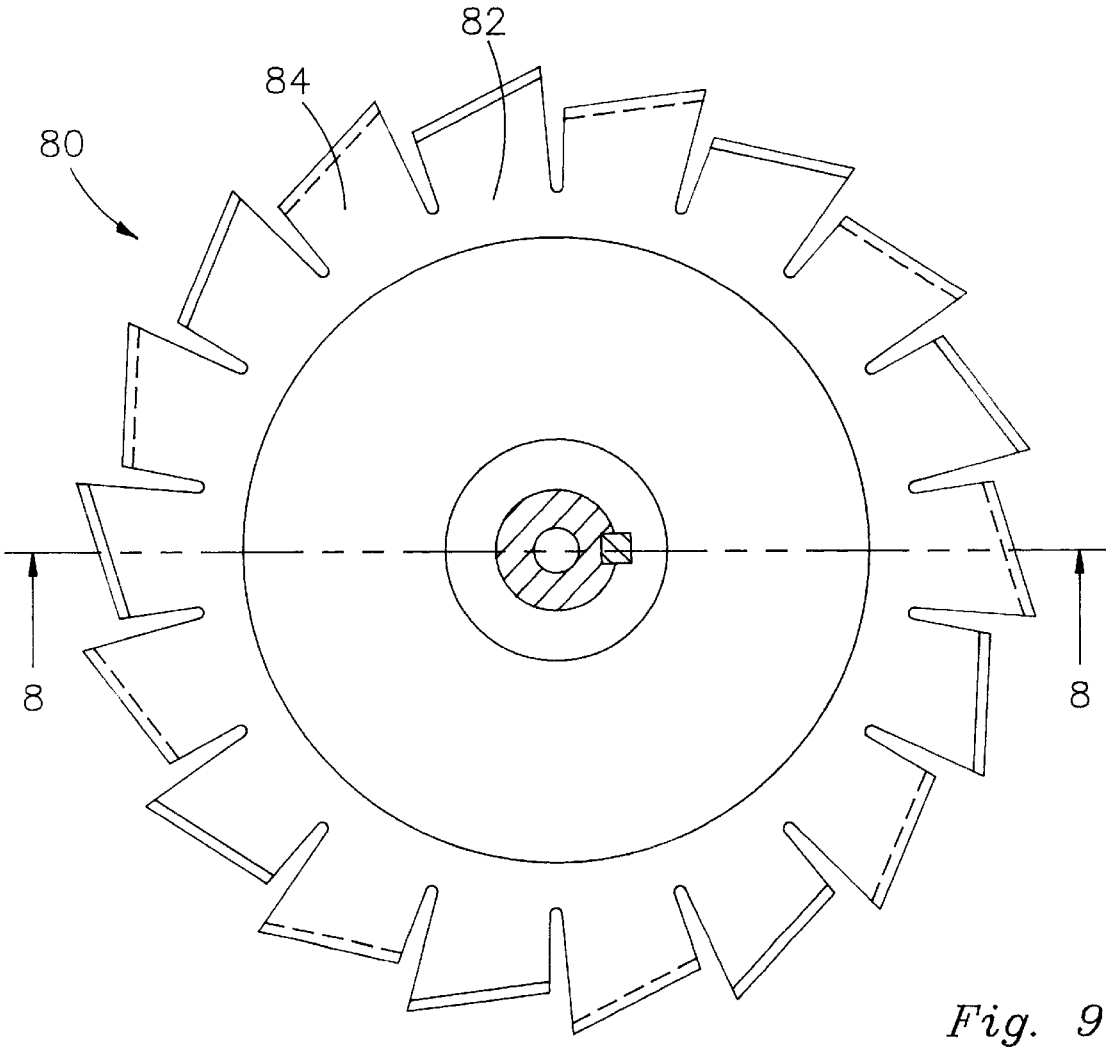
Fig. 9 PRIOR ART

Another type of mounting means common in the art of mixing is the so-called "Taper-Lock" type of bushing, in which a bushing at the center of the impeller forms a tapered surface, and the side edges of the shaft are urged against the inner surface of the bushing by means of screws disposed parallel to the central opening. FIG. 7 shows a "Taper-Lock" bushing in place in an impeller of the present invention. Like the previously-mentioned structures, this type of bushing may be used with grooves on the outer edge of the bushing, or a plurality of stiffening ribs embedded in the plastic of the impeller.

Method of Making the Impeller

Figure 10:
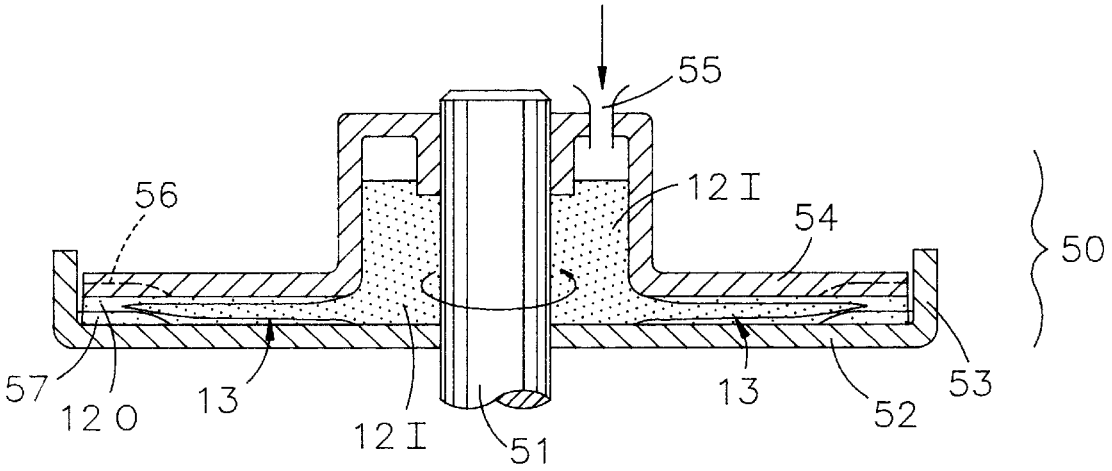
FIG. 10 is a schematic sectional view of a centrifugal casting mold illustrating one form of apparatus and method for making composite polyurethane impellers in accordance with this invention.

FIG. 10 schematically shows one form of method in accordance with this invention. The number 50 designates a typical centrifugal casting mold, shown as driven by a shaft 51. Mold 50 has a floor 52 and confining end wall 53 and a top cover 54 also rotating with the shaft 51. A feed opening 55 is provided for introducing polyurethane feed materials into the shape defined between the floor 52 and the cover 54.

According to one form of the method a limited quantity of a polyurethane batch serving as a precursor for the outer impeller portion 12 O is poured into the feed opening 55 and is centrifugally projected radially outwardly to fill only the space 12 O located outwardly of the interface 13. While this material is still soft and pliable enough to be chemically reactive another batch, this time of polyurethane material serving as precursor of the inner impeller portion and hub 12 I, is poured into feed opening 55 for flow centrifugally outwardly for tight pressure engagement at interface 13 with the outer polyurethane 12 O. Under temperature conditions suitable for reaction the two different polyurethane materials are centrifugally bonded to each other chemically, physically or both in a manner to produce the formed impeller which, after suitable heat curing, is serviceable as an impeller.

Suitable inserts such as 56,57 may be provided to shape the desired grooves into the peripheral edge of the impeller.

In many applications of impellers, it is inadvisable to immerse metal parts in the liquid being mixed. When firing ceramics for example, metal parts within the mix may cause sparks which affect the glaze. Further, since bushings used on many types of machinery are made of carbon steel, the bushings will be etched by use in a corrosive environment, such as a strong acid. This problem could be partially avoided by providing a stainless steel bushing, but such bushings are expensive. With the present invention, the impeller is made entirely of polyurethane, which is less expensive than stainless steel and has none of the disadvantages of carbon steel. Further, because the composite polyurethane impeller of the present invention is molded in chemically reacted layers in a centrifugal process, the impeller may be perfectly balanced upon manufacture, and thus will not require the drilling of small balance holes to prevent wobbling of the impeller.

Since the impeller 10 is made of at least two layers of molded polyurethane the softer, more flexible layer 12 O may be arranged at the outer periphery where its linear velocity is much higher than the linear velocity at the inner portion 12 I. It has been found that even at such higher linear velocities the flexible polyurethane has radically superior resistance to abrasion. When employed in the mixing of liquids having abrasive solids suspended therein, the softer more flexible polyurethane resin having a Durometer hardness below about 95A has the desirable property of wearing slowly and gradually. Metals and various types of plastics have a disadvantageous or even dangerous tendency to break off in large particles as they wear.

When the impeller is immersed into a liquid and rotated, the motion of the impeller sets up a vibration around the relatively soft and flexible periphery of the disk 12. The alternating configurations of the grooves 20 and 22 on the upper and lower faces of the disks 10 induce an up and down motion of the liquid around the periphery of the impeller. This has been found to be very effective especially in high viscosity systems.

The impeller 10 is preferably designed so that it may be turned over relative to the end of shaft 14, allowing either face of disk 12 to face upward. Turning the impeller 10 over has the effect of abrading opposite edges of the vanes. This feature is useful in that the side of the groove against which liquid is flowing when the impeller is rotating may tend to wear down faster than the opposite edge on the same groove. By turning the disk over the user can expose the lesser-worn edges of each of the grooves to the direct shearing of the liquid, thus extending the life of the impeller.

The preferred embodiment is designed to be rotated at a tangential velocity of 5000–6000 ft/min in a liquid viscosity above 500 centipoises.

Compared to the impeller of the present invention, already known variations such as using a larger number of smaller grooves, or grooves forming surfaces with right angle corners have certain disadvantages associated with them.

Having a large number of small grooves will result in a relatively larger total surface area of the impeller, which will result in faster wear. Smaller grooves tend to provide intense eddy currents concentrated in a small volume around the impeller, which causes the mixing of high-viscosity liquids to take longer, and also provides greater resistance to the drive motor. A greater resistance to the drive motor will result in a larger current draw from the drive motor. The arrangement of grooves on the present invention is old but is more efficient than some previous impellers in the senses of time savings, physical wear, and energy consumption. The combination, with the disk having two hardness portions of the present invention, of a relatively small number of grooves, each having a certain size and a curved shape, gives the preferred embodiment of the present invention.

Further, recent restriction on the use of certain materials in paints, as well as the recent increases in price of high-quality minerals, have led many paint manufacturers to include low-quality coarsely-ground solids in paint mixtures. These coarse solids seriously abrade prior impellers, and a large number of small grooves will wear down faster than a smaller number of relatively large grooves.

It has been found that the composite polyurethane impeller of the present invention has a useful life drastically longer than metal impellers or even polymeric impellers of the prior art. It is expected that the impeller of the present invention will last about ten times longer than metal impellers in comparable work situations.

The implications of cost saving by use of the present invention are important.

It will be appreciated that many variations may be made without departing from the invention. For example, more than two different polyurethanes may be used to form a multiple layer impeller. The juncture of the outer end of interface 13 may be closer to or farther removed from the disk center. Various mechanical connections may be used to connect the impeller to the rotating shaft. And the number, spacing, shape and configuration of the grooves may be widely varied. Indeed, while the grooves are preferably formed only in the outer layer 12 O they may be present in both layers if desired.

The present invention may be embodied in other specific forms without departing from the spirit or essential attributes thereof and, accordingly, reference should be made to the appended claims, rather than to the foregoing specification, as indicating the scope of the invention.

I claim:

1. A method of making an impeller having inner and outer portions of polyurethane resin having different flexibilities, the outer portion being bonded to the inner portion, the outer portion having greater flexibility than the inner portion, comprising the steps of:

(a) rotating a centrifugal casting mold containing at an outer portion of the mold a first polyurethane resin forming material of predetermined composition, (b) introducing into an inner portion of said mold a second polyurethane resin forming material of different composition than the first polyurethane resin forming material at said outer portion, (c) centrifugally casting the first and second polyurethane resin forming materials respectively to form inner and outer portions of said impeller, and (d) curing the formed inner and outer portions under conditions of temperature and time to form an impeller disk having inner and outer portions of polyurethane resin having different flexibilities, the outer portion being bonded to the inner portion and having greater flexibility than the inner portion.

2. The method defined in claim 1 wherein the resin forming materials are reactive with each other.

3. The method defined in claim 2 wherein the curing forms a chemical bond between said inner and outer portions of the impeller.

* * * * *